United States Patent [19]

Cohen

[11] Patent Number: 4,902,428

[45] Date of Patent: Feb. 20, 1990

[54] METHOD AND APPARATUS FOR SEPARATING MAGNETIC MATERIAL

[75] Inventor: Henry E. Cohen, Middlesex, England

[73] Assignee: GEC Mechanical Handling Limited, England

[21] Appl. No.: 280,573

[22] Filed: Nov. 22, 1988

Related U.S. Application Data

[63] Continuation of Ser. No. 90,251, Jul. 27, 1987, abandoned.

[30] Foreign Application Priority Data

Dec. 10, 1985 [GB] United Kingdom ..... 8530360

[51] Int. Cl.[4] ..... B03C 1/08

[52] U.S. Cl. ..... 210/695; 55/3; 55/100; 209/214; 209/223.1; 209/232; 210/222

[58] Field of Search ..... 209/214, 223.1, 232, 209/478; 55/2, 3, 100; 210/222, 223, 695

[56] References Cited

U.S. PATENT DOCUMENTS

| | | | |
|---|---|---|---|
| 676,618 | 6/1901 | Edison | 209/223.1 |
| 971,692 | 10/1910 | Schnelle | 210/222 |
| 1,103,358 | 7/1914 | Hess | 210/222 |
| 3,608,718 | 9/1971 | Aubrey, Jr. et al. | 210/222 |
| 3,984,309 | 10/1976 | Allen | 209/214 |
| 4,102,780 | 7/1978 | Sun et al. | 209/223.1 |
| 4,478,711 | 10/1984 | Cohen et al. | 209/232 |

FOREIGN PATENT DOCUMENTS 2317013 6/1975 France .

*Primary Examiner*—W. Gary Jones

*Attorney, Agent, or Firm*—Kirschstein, Ottinger, Israel & Schiffmiller

[57] ABSTRACT

Separation of admixtures of particles, fluids or gases having different magnetic susceptiblities is effected by subjecting a moving stream of the mixture to simultaneous gravitational and magnetic forces in a manner such that relatively non-magnetic materials respond significantly to the gravitational force and relatively magnetic materials respond preferentially to the magnetic force.

17 Claims, 2 Drawing Sheets

METHOD AND APPARATUS FOR SEPARATING MAGNETIC MATERIAL

This is a continuation of application Ser. No. 07/090,251 filed July 27, 1987, now abandoned.

BACKGROUND OF THE INVENTION

1. Field of the Invention

This invention relates to magnetic separators and methods of use thereof. The invention is concerned with the separation of admixtures of particles, fluids and gases into separate products of relatively higher magnetic susceptibility and products of relatively lower or zero magnetic susceptibility. Relatively magnetic particles and/or fluids may thus be separated from relatively nonmagnetic particles and/or fluids from a flowing stream of the admixture which is fed to the process. The fluid may be liquid, eg. water, emulsions, or suspensions. The term "particle" as used above and throughout the specification refers to sizes ranging from submicrometers to several centimeters or more, unless the context dictates otherwise.

2. Description of Related Art

Hitherto magnetic separations have suffered severe constraints arising variously from small magnetic working volumes, entrapment of material in the wrong product, blockage due to permanent capture of magnetic material, or blockage due to oversize particles. These constraints usually affect adversely the quality of the separated products and/or the throughput capacity of the separator.

SUMMARY OF THE INVENTION

In the new process, improved efficiency of separation can be attained at high rates of throughput. The separation is effected in a stream or moving bed of material, by subjecting the stream or bed simultaneously to gravitational and magnetic forces in a manner so that relatively nonmagnetic materials respond significantly to the gravitational force and relatively magnetic materials show a gravitational response which is significantly modified by the magnetic force.

In accordance with the present invention the separator system comprises a pinched sluice, as used for gravitational separation and a disc-shaped magnet which, depending on the necessary magnetic force, may be a permanent magnet assembly, a conventional electromagnet solenoid, or a superconducting solenoid. In one embodiment of the invention the magnet is so placed adjacent to the pinched sluice that the magnetic force is directionally opposed to the gravitational force. The magnitude of the magnetic force is adjusted so that its lifting effect reduces the "apparent density" of the magnetic material substantially. Thus the magnetic force is used to make the more magnetic material behave as an apparently light material, of lower density than the nonmagnetic material which is not affected by the magnetic force. This results in enhanced efficiency of gravity separation on the sluice.

For example, in a chromite ore the valuable mineral chromite has a density of about 4.5 and associated ferromagnesian silicate gangue minerals have densities of about 3.5, a density differential of 1. By the use of a suitable magnetic force it is possible to lower the apparent density of chromite to about 1.5. Thus the density differential is reversed and increased to 2. This permits much cleaner separation on the sluice, compared with gravity separation alone without the magnetic force.

In performing a separation on a sluice, a forward movement or flow needs to be imparted to the feed mixture so that it travels over the sluice from the wide feed entry area to the relatively narrow discharge area. The forward movement is produced by liquid flow down the inclined sluice from the feed entry to the product discharge. For separation without a liquid medium, a similar flow effect is achieved with dry feeds by passing secondary air upwards through the porous base of the sluice bed. The flow can be assisted by imparting a vibratory motion to the sluice.

In conjunction with the forward flow of the material, the opposing forces of gravity and of the magnetic field produce a progressive stratification in which the magnetic material of low apparent density forms an upper layer and the nonmagnetic material forms a lower layer in the stream. As the sluice narrows progressively towards the discharge, the stream of moving material is compressed laterally and the two layers progressively grow in depth. The two layers are separated on discharge by means of a splitter placed at the interface of the discharge trajectories of the apparent "light" magnetic product and the relatively "heavy" nonmagnetic product. It is an essence of the present invention that the magnetic force is only strong enough to produce a reduced effective density of the magnetic material thus assisting efficient gravitational stratification. The magnetic force should not be strong enough to lift the magnetic particles. The magnetic product layer should rest upon the nonmagnetic product layer so that it is supported and transported by the latter. This is an essential distinction from other magnetic separators where the magnetic force needs to be large enough to overcome some opposing force to collect the magnetic product.

In another embodiment of the invention the solenoid magnet is so placed as to assist the gravitational force and hence to produce a greater density differential on the sluice bed than is obtainable by gravity alone. In this case the magnetic material attains a higher apparent density and the density differential is improved to give a better gravity separation than that obtainable by gravity alone. For example, with the chromite mentioned above, the apparent density can be raised from about 4.5 to about 6.5, giving a density differential of 3 with the gangue density of 3.5. The magnetic force is employed only to enhance gravitational segregation and thus to improve gravity separation. The magnetic force should not be large enough to collect the magnetic product, because that would entail a risk of arresting the magnetics on the sluice bed.

A magneto-gravitational separator for carrying out the above method and in accordance with the invention conveniently comprises an annular superconducting solenoid magnet placed between two inclined annular sluices. The feed mixture of magnetic and nonmagnetic material enters both sluices around their outer peripheries and flows down over both inclined sluices towards their common central axis. Under the influence of the magnetic force generated by the field strength and field gradient of the solenoid magnet, the magnetic material on the upper sluice will form the lower, apparently denser layer. Simultaneously, the magnetic material on the lower sluice will form the upper apparently less dense layer. The central axial discharge streams from the two sluices will follow trajectories as shown in FIG. 1, merging into three distinctive concentric streams, viz.

a central stream of nommagnetics from the upper sluice, surrounded concentrically by an annular stream of magnetics which, in turn, is surrounded by an outer concentric stream of nonmagnetics from the lower sluice. The products are separated by an inner splitter tube and an outer splitter ring respectively. Both splitters can be adjusted vertically so as to intersect the discharge streams at the desired interfaces. The effective magnetic force for optimum separation can be adjusted by varying the current in the superconducting solenoid and by varying the vertical distances between the solenoid and each of the two sluices.

Alternative embodiments of the invention may use only one sluice, above or below the magnet, as may be dictated by physical characteristics of the feed mixture to be treated and depending on whether it is more advantageous to make the magnetic product apparently heavier or apparently lighter than the nonmagnetic material so as to achieve the best gravity differential. Similarly, one of the two sluices may be used for a first stage of separation and the second sluice may be used for a second stage separation of one of the products of the first stage. In a further embodiment of the invention, the circular sluices may be divided into two or several sectors receiving different feeds, or different stage products for treatment. Similarly, individual wedge-shaped sluice segments may be used in place of complete circular sluices.

In order to attain high capacities of throughput it is desirable to use magnetic forces of high strength and with a deep reach. It is therefore preferred to use superconducting magnets which are capable of producing field strengths in excess of 2.5 Tesla. Normal copper coil solenoids can be used when weaker magnetic forces suffice. However, copper coils would suffer problems of heat dissipation and would consume considerably more electric power than superconducting coils. Permanent magnets may be used for this invention if the magnetic product has sufficiently high magnetic susceptibility. Possible examples of such products are magnetite, or ferrosilicon.

BRIEF DESCRIPTION OF THE DRAWINGS

The invention will now be described by way of example with reference to the accompanying sketch drawings in which.

DETAILED DESCRIPTION OF THE PREFERRED EMBODIMENTS

Figure 1:
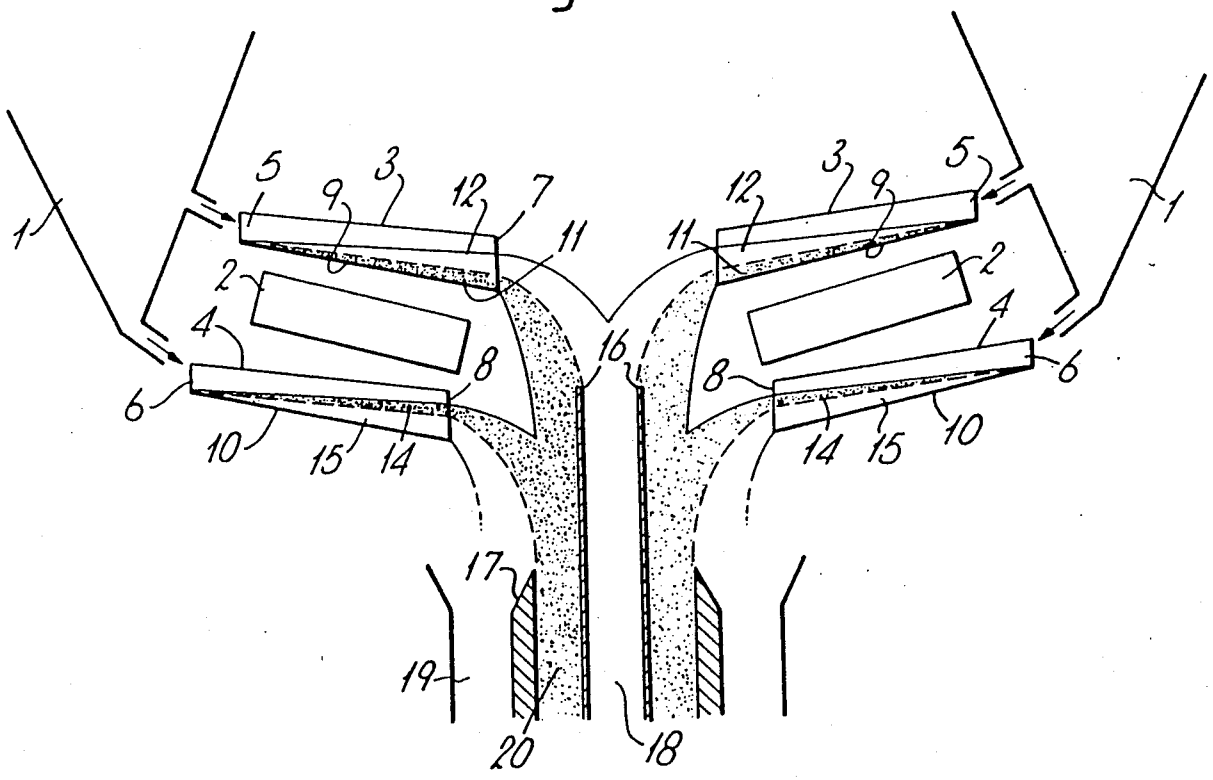
FIG. 1 is a section through one embodiment of a separator in accordance with the invention.

Referring to FIG. 1, the separator comprises an annular magnet member generally indicated at 2 comprising one solenoid coil in a block or housing. The coil generates a strong magnetic force which pulls magnetically susceptible material towards the upper and lower surfaces of the coil block.

Material to be separated is fed from an annular feed hopper or feed tank generally indicated at 1 onto the outer peripheries 5 and 6 of the two annular sluices indicated generally at 3 and 4. The design of the feed system is not critical to the invention. Any system supplying feed to the periphery of the sluices is acceptable. Particulate material in a liquid suspension will flow naturally down the inclined sluices towards the discharge edges at 7 and 8 respectively.

Dry particulate material will flow similarly, provided that it is fluidized by means of secondary air injected throughout the bases of the sluices indicated generally at 9 and 10, the bases, in such a case, then being made suitably porous for this purpose.

Figure 2:
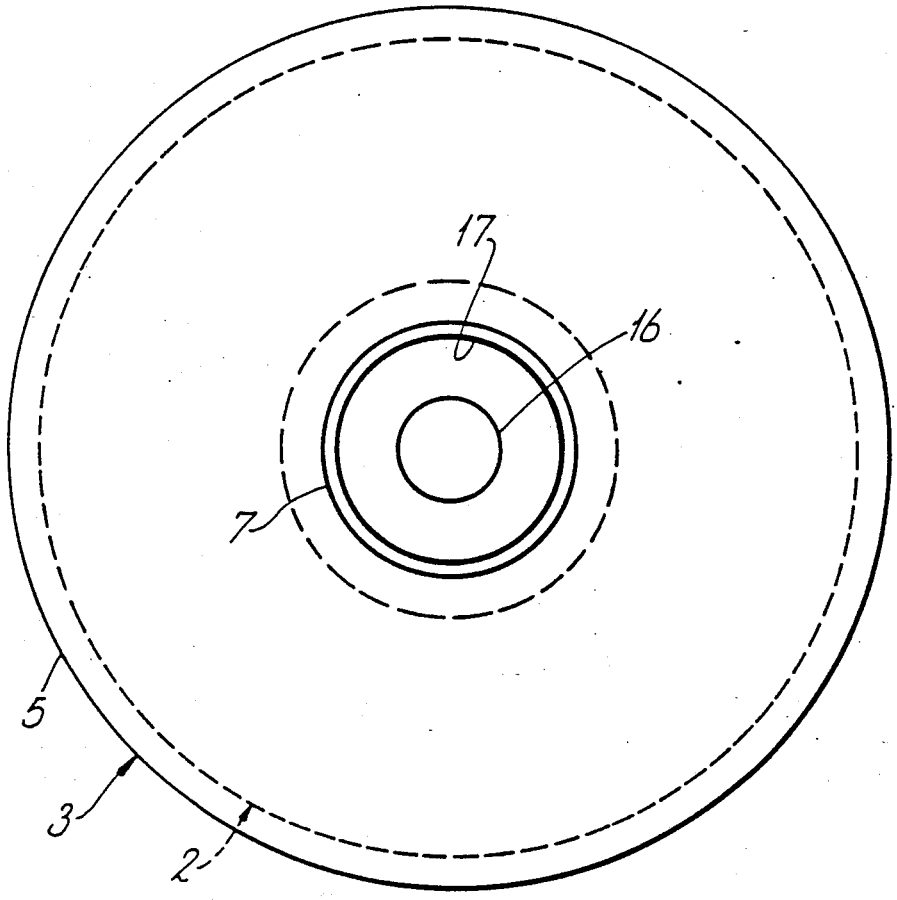
FIG. 2 is a top plan view of part of the separator.

As the mixed material flows down the sluice it will unmix by a process of stratification. This process is induced by the combined effects of gravitational and magnetic forces. On the upper sluice 3 the magnetic product will form the lower layer 11 and the nonmagnetic product will form the upper layer 12. On the lower sluice 4 the magnetic product will form the upper layer 14 and the nonmagnetic product will form the lower product 15. The layers are thin when they begin to form near the outer periphery of the sluice. FIG. 2 shows that as these layers flow from the periphery at 5 towards the central edge of the sluice at 7 they are compressed circumferentially. Hence, the layers grow in vertical depths, as shown in FIG. 1. This facilitates their separation on discharge by means of tubular splitters as shown generally at 16 and 17. The splitter can be adjusted vertically so as to be located at the interfaces between the layers 11 and 12, and the layers 14 and 15 respectively. Consequently, the splitters 16 and 17 divide the discharge streams into 3 concentric product flows, viz a central product 18 of the nonmagnetic layer 12; an annular product 20 of the combined magnetic layers 11 and 14; and an outer annular product 19 of the nonmagnetic layer 15.

The magnetic force can be adjusted by varying the electric current in the solenoid magnet 2 and by varying the distances between the magnet and the sluice beds. A higher current and/or a smaller distance yield higher magnetic forces. The main purpose of these adjustments is to produce well defined interfaces, between the layers 11 and 12 and the layers 14 and 15 respectively, so as to facilitate the location of splittrs 16 and 17 for efficient separation between the magnetic and nonmagnetic products.

The positions of the splitters 16 and 17 can be adjusted separately so as to take into account the volumetric quantities of magnetic and nonmagnetic components in different feeds. This vertical adjustment of the splitters also allows for different trajectories of the separated layers, in response to particle size and/or particle mass variations. Further, the separate vertical adjustment of the splitters 16 and 17 can be used to compensate for trajectory changes arising from different flow velocities of the layers, due to dilution or viscosity factors with liquid suspensions, or due to different volumes of secondary air with dry feeds.

Although in the embodiment above described the splitters are disposed within the trajectories of the material discharged from the sluices, it will be apparent that the splitters can in some cases be located either vertically or horizontally at the lower end of a sluice where separation of the material into two layers has been effected.

The invention can also be used to separate from a mixture of different materials, particles which are not inherently magnetic, but which can be rendered magnetic, at least temporarily, prior to the separation process. In some cases this can be achieved by incorporating into the mixture a finely divided ferromagnetic material which is more readily adherent to or absorbed by those particles than other particles in the mixture.

Such a process may be used for the separation of some biological materials from a liquid containing them, or from a mixture of those materials and other materials which are less susceptible than said magnetic material, for example for purifying purposes, or for eliminating undesirable elements from a liquid or admixture of particles in both the food and other industries.

I claim:

1. A method of separating an admixture of particles or fluids into separate products of relatively higher magnetic susceptibility and relatively lower or zero magnetic susceptibility, comprising the steps of:

(a) feeding a stream of the admixture along a pinched annular sluice from a wider input end to a narrower outlet end;

(b) stratifying the stream into contacting layers, one upon another, each layer mainly incorporating a different component of the admixture and extending between the input and outlet ends of the pinched annular sluice by subjecting the stream to a magnetic field which produces a differential force on components of the admixture having different magnetic susceptibilities, as they are fed along the pinched annular sluice, sufficient to produce a stratification of the stream to form said layers; and (c) directing the layers of the stream into respective output channels.

2. A method according to claim 1 wherein the magnetic field is produced by an apertured disc-shaped magnet disposed so that the stream of material is fed past the magnet substantially parallel to a face thereof.

3. A method according to claim 2 wherein the magnet is a superconducting solenoid magnet.

4. A method of separating an admixture of particles or fluids into separate products of relatively higher magnetic susceptibility and relatively lower or zero magnetic susceptibility, comprising the steps of:

(a) feeding a stream of the admixture along a flow path by directing the stream along a pinched sluice from a wider input end to a narrower outlet end, as considered along a transverse direction across the flow path, said feeding step including the step of increasing the depth of the stream as the stream travels from the input end to the outlet end;

(b) stratifying the stream of increasing depth into contacting layers, each of increasing depth, one upon another, each layer of increasing depth mainly incorporating a different component of the admixture and extending between the input and outlet ends of the pinched sluice by subjecting the stream of increasing depth to a magnetic field which produces a differential force on components of the admixture having different magnetic susceptibilities, as they are fed along the pinched sluice, sufficient to produce a stratification of the stream of increasing depth to form said layers, each of increasing depth; and (c) directing the layers, each of increasing depth, of the stream of increasing depth into respective output channels.

5. A method according to claim 4 wherein the different layers are directed into the respective output channels by splitter means disposed within the trajectory of the stream of material discharged from the sluice.

6. A method according to claim 4 of separating a component of higher density and higher magnetic susceptibility from a component of lower density and lower or zero magnetic susceptibility, wherein the magnetic field is produced by a magnet disposed beneath the sluice so as to assist the separating effect of gravity on the different components.

7. A method according to claim 4 of separating a component of lower density and higher magnetic susceptibility from a component of higher density and lower or zero magnetic susceptibility, wherein the magnetic field is produced by a magnet disposed beneath the sluice so as to oppose the separating effect of gravity on the different components.

8. A method according to claim 4 of separating a component of higher density and higher magnetic susceptibility from a component of lower density and lower or zero magnetic susceptibility, wherein the magnetic field is produced by a magnet disposed above the sluice so as to oppose the separating effect of gravity on the different components.

9. A method according to claim 4 of separating a component of lower density and higher magnetic susceptibility from a component of higher density and lower or zero magnetic susceptibility wherein the magnetic field is produced by a magnet disposed above the sluice so as to assist the separating effect of gravity on the different components.

10. A magnetic separator for separating an admixture of particles or fluids into separate products of relatively higher magnetic susceptibility and relatively lower or zero magnetic susceptibility, comprising:

(a) a pinched sluice having a bed extending along a flow path from a wider input end to a narrower outlet end, as considered along a transverse direction across the flow path;

(b) means for feeding a stream of the admixture onto the bed of the sluice at the input end to cause the stream to be fed along the bed to the outlet end, and for increasing the depth of the stream as the stream travels from the input end to the outlet end;

(c) stratifying means including a disc magnet disposed with a face thereof substantially parallel to the bed of the sluice, said stratifying means being operative for stratifying the stream of increasing depth into contacting layers, each of increasing depth, one upon another, each layer of increasing depth mainly incorporating a different component of the admixture and extending between the inlet and outlet ends of the pinched sluice by producing a differential magnetic force on components of the admixture having different magnetic susceptibilities as they are fed along the sluice, so as to stratify the stream of increasing depth and form said layers, each of increasing depth, in the bed;

(d) a plurality of output channels adjacent the outlet end of the sluice; and (e) splitter means disposed away from the sluice so as to divide the discharge from the sluice into said separate products and direct said products into different respective output channels.

11. A magnetic separator according to claim 10 wherein the position of the splitter means is adjustable to vary the proportions of the discharge which is fed into the different output channels.

12. A magnetic separator according to claim 10 wherein the sluice is an inclined annular sluice, the magnet is an annular superconducting magnet, and the splitter means is of tubular form disposed coaxially below the outlet end of the sluice.

13. A magnetic separator according to claim 10 wherein the magnet consists of a superconducting solenoid.

14. A magnetic separator according to claim 13 incorporating means for adjusting the position of the solenoid relative to the sluice.

15. A magnetic separator according to claim 13 wherein the magnetic force acting on the stream is adjustable by varying the current in the superconducting solenoid.

16. A magnetic separator according to claim 10 incorporating two inclined annular sluices disposed coaxially one above the other with a superconducting magnet disposed between them so as to separate the stream on both sluices into layers consisting of the different components but with the positions reversed, the splitter means comprising a pair of tubes disposed coaxially with respect to the sluices in positions such that the upper stream from the upper sluice is directed into the inner tube, the lower stream from the upper sluice, and the upper stream from the lower sluice are directed into the space between the splitter tubes, and the lower stream from the lower sluice is fed into a channel surrounding the outer tube.

17. A magnetic separator according to claim 16 wherein the positions of both splitter tubes are adjustable vertically.

* * * * *